US006663213B2

(12) United States Patent
Kosugi

(10) Patent No.: US 6,663,213 B2
(45) Date of Patent: Dec. 16, 2003

(54) METHOD AND DEVICE FOR VERIFYING COLORING AGENT CARTRIDGE FOR PRINTER

(75) Inventor: Tadatsugu Kosugi, Sagamihara (JP)

(73) Assignee: Akira Suzuki, Kanagawa-ken (JP)

( * ) Notice: Subject to any disclaimer, the term of this patent is extended or adjusted under 35 U.S.C. 154(b) by 0 days.

(21) Appl. No.: 10/205,804

(22) Filed: Jul. 26, 2002

(65) Prior Publication Data

US 2003/0052936 A1 Mar. 20, 2003

(30) Foreign Application Priority Data

Sep. 14, 2001 (JP) ..... 2001-279729

(51) Int. Cl.[7] ..... B41J 29/393
(52) U.S. Cl. ..... 347/19; 347/14; 399/12
(58) Field of Search ..... 399/12, 13, 24, 399/25; 347/7, 19; 324/259; 345/173; 400/196

(56) References Cited

U.S. PATENT DOCUMENTS 6,246,393 B1 * 6/2001 Watanabe et al. ..... 345/173
6,343,883 B1 * 2/2002 Tada et al. ..... 400/196
6,398,335 B1 * 6/2002 Benjamin ..... 347/19
6,477,335 B1 * 11/2002 Surya et al. ..... 399/12

* cited by examiner

*Primary Examiner*—Stephen D. Meier
*Assistant Examiner*—Lam Nguyen
(74) *Attorney, Agent, or Firm*—Hoffmann & Baron, LLP

(57) ABSTRACT

In order to verify a magnetic card and so on, the principle: an amorphous alloy material generates a magnetic pulse due to the Barkhausen effect at a predetermined magnetic level, is used. In this connection, a method for verifying a replaceable coloring agent cartridge loaded in a printer includes providing an amorphous magnetic member on a genuine coloring agent cartridge loaded in a main body; providing, in the main body, an exciting coil for exciting the amorphous magnetic member in an AC magnetic field and a detecting coil for detecting the AC magnetic field passing through the amorphous magnetic member; and verifying the coloring agent cartridge based on whether or not a magnetic pulse which is generated at a predetermined level of the AC magnetic field and which is superimposed on a detection signal of the detecting coil is generated at a predetermined phase position in a period of the AC magnetic field.

8 Claims, 3 Drawing Sheets

METHOD AND DEVICE FOR VERIFYING COLORING AGENT CARTRIDGE FOR PRINTER

BACKGROUND OF THE INVENTION

1. Field of the Invention

The present invention relates to a method and device for verifying a coloring agent cartridge for a printer, in which it is determined whether or not a replaceable coloring agent cartridge loaded in a printer is genuine.

2. Description of the Related Art

Generally, replaceable ink cartridges or toner cartridges are loaded in a printer. For example, when an ink is completely consumed in a color printer, a corresponding one of the black and color ink cartridges, or a single unit cartridge containing all colors can be replaced.

When this type of coloring agent cartridge is replaced, a non-genuine cartridge may be loaded in the main body of the printer instead of a genuine cartridge. However, conventionally the main body has not had a function for verifying the loaded cartridge.

SUMMARY OF THE INVENTION

Accordingly, it is an object of the present invention to provide a method and device for verifying a coloring agent cartridge for a printer, in which verification can be easily performed even when a loaded non-genuine coloring agent cartridge cannot be distinguished merely by its appearance.

In order to achieve the above described object, the inventors of the present invention have directed their attention to that, the following principle: an amorphous alloy material generates magnetization noise due to the Barkhausen effect, that is, a magnetic pulse, at a predetermined magnetic level, is used to verify a magnetic card and so on.

According to an aspect of the present invention, a method for verifying a replaceable coloring agent cartridge loaded in a printer comprises providing an amorphous magnetic member on a genuine coloring agent cartridge to be loaded in a main body; providing, in the main body, an exciting coil for exciting the amorphous magnetic member in an AC magnetic field and a detecting coil for detecting the AC magnetic field passing through the amorphous magnetic member; and verifying the coloring agent cartridge based on whether or not a magnetic pulse which is generated at a predetermined level of the AC magnetic field and which is superimposed on a detection signal of the detecting coil is generated at a predetermined phase position in a period of the AC magnetic field.

It is determined that the magnetic pulse is superimposed on the predetermined phase position in the period of the AC detection signal corresponding to the AC magnetic field, when the detecting coil detects the AC magnetic field passing through the amorphous magnetic member attached to or embedded in the genuine coloring agent cartridge. The amorphous magnetic member may be in the form of a piece, line, film, or powder. If the cartridge is non-genuine, the magnetic pulse is not generated. Even if the amorphous magnetic member is attached, the magnetic pulse is not generated at the predetermined phase position in the period of the AC magnetic field, and thus the cartridge is determined to be non-genuine. A non-genuine ink cassette can be easily detected because it is difficult to fabricate the same type of amorphous magnetic members.

By verifying the coloring agent cartridge based on pattern recognition such as the amplitude and pulse width of the magnetic pulse, in addition to whether or not the magnetic pulse is generated at the predetermined phase position in the period of the AC magnetic field, the verification accuracy is further increased.

According to another aspect of the present invention, a device for verifying a replaceable coloring agent cartridge loaded in a printer comprises an amorphous magnetic member provided on the coloring agent cartridge loaded in a main body; an exciting coil for exciting the amorphous magnetic member in an AC magnetic field and a detecting coil for detecting the AC magnetic field passing through the amorphous magnetic member, the coils being provided in the main body; a verifying unit for verifying the coloring agent cartridge based on whether or not a magnetic pulse which is generated at a predetermined level of the AC magnetic field and which is superimposed on a detection signal of the detecting coil is generated at a predetermined phase position in a period of the AC magnetic field; and a print preventing unit for stopping the operation of the printer so that printing cannot be performed when the coloring agent cartridge is determined to be non-genuine. With this configuration, a non-genuine ink cassette can be easily detected and a printing operation is automatically prevented when the non-genuine cartridge is loaded.

In a color printer in which a plurality of replaceable coloring agent cartridges can be loaded, at least the detecting coil is provided for each of the coloring agent cartridges, the detecting coils being arranged in parallel. That is, the exciting coil is provided for all or each of the cartridges, and the detecting coil is provided for the respective cartridges.

In a color printer in which a plurality of replaceable coloring agent cartridges can be loaded in a print head, which moves in the line direction, one exciting coil and one detecting coil are provided along a transport path of the print head so as to scan and verify the plurality of coloring agent cartridges in order when the print head moves in the line direction.

In a color printer in which a plurality of replaceable coloring agent cartridges can be loaded, one exciting coil and one detecting coil are provided so as to move on a rail placed along the alignment direction of the plurality of coloring agent cartridges so as to scan and verify the plurality of coloring agent cartridges in order.

The device further comprises a magnetic pulse extracting unit for extracting the magnetic pulse superimposed on the detection signal of the detecting coil. Also, the verifying unit verifies the coloring agent cartridge based on pattern recognition such as the amplitude and pulse width of the magnetic pulse, in addition to whether or not the extracted magnetic pulse is generated at the predetermined phase position in the period of the AC magnetic field. With this arrangement, the verification accuracy is increased.

The verifying unit verifies the coloring agent cartridge when it is detected that the coloring agent cartridge is loaded in the main body. Accordingly, the verification is automatically performed when the coloring agent cartridge is replaced.

DESCRIPTION OF THE PREFERRED EMBODIMENTS

Figure 1:
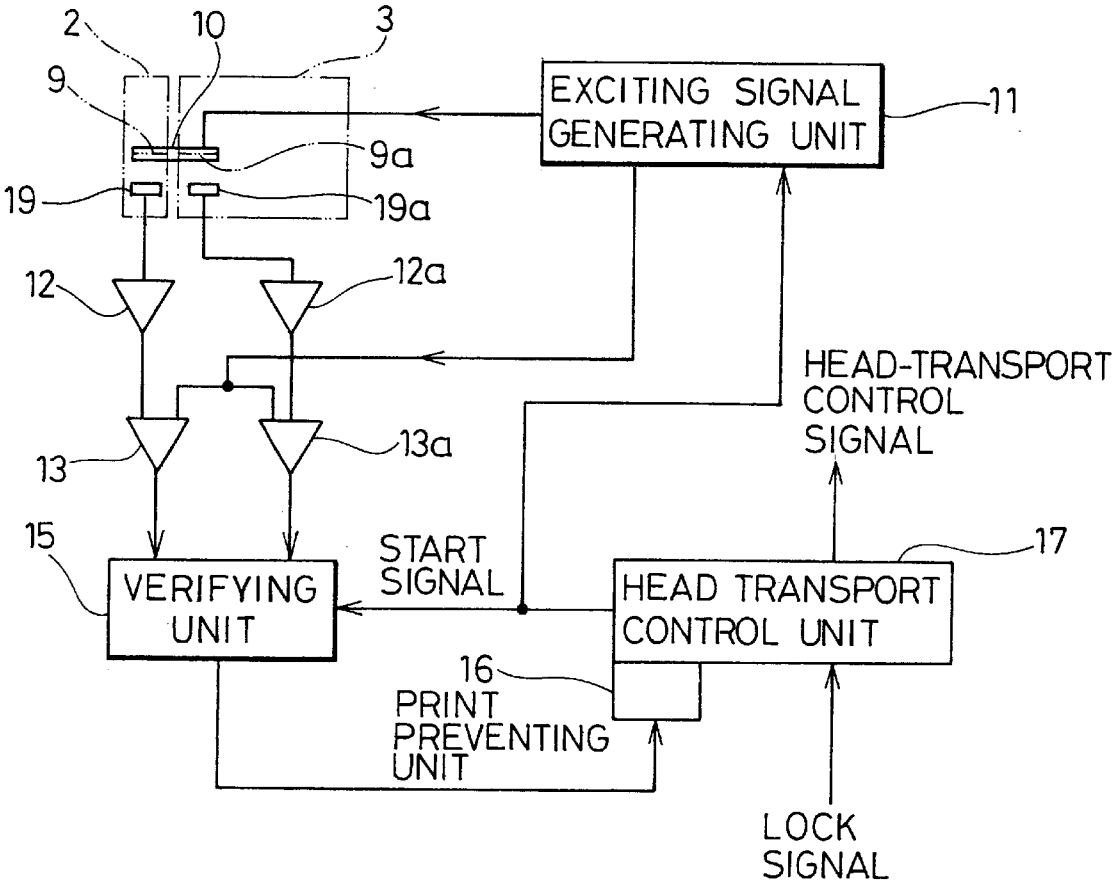
FIG. 1 shows the configuration of a device for verifying an ink cartridge according to an embodiment of the present invention.

Hereinafter, a device for performing a method for verifying a coloring agent cartridge for a color inkjet printer according to an embodiment of the present invention will be described with reference to FIGS. 1 and 2. As shown in FIG. 2, a color printer 1 includes a print head 8 which is driven in a reciprocating manner in the line direction of the color printer 1. A replaceable black ink cartridge 2 and color ink cartridge 3 including five colors of ink, such as cyan, magenta, etc., are set in the print head 8. Further, the ink cartridges 2 and 3 are covered with attached lids 4 and 5, respectively, and claws 4*b* and 5*b* are provided to be engaged with hooks 4*a* and 5*a*, respectively, so as to be locked.

Figure 2:
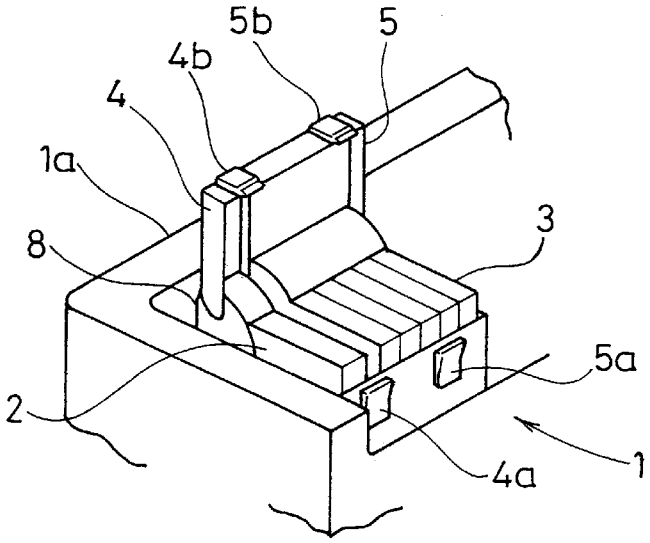
FIG. 2 is a perspective view showing a print head part of the device.

As shown in FIG. 1, the back surfaces of the genuine ink cartridges 2 and 3 are provided with linear thin-film amorphous magnetic members 9 and 9*a*, respectively, which cause changes in magnetization by the Barkhauzen effect in a magnetized region just before saturation. The alloy material and the manufacturing method of the amorphous magnetic members are selected in advance so that the members have a specific magnetic characteristic. An exciting coil 10, which is placed close to and in parallel with the amorphous magnetic members 9 and 9*a* of the ink cartridges 2 and 3 loaded in the print head 8 and which excites the amorphous magnetic members 9 and 9*a* by an AC magnetic field, and detecting coils 19 and 19*a* for detecting the AC magnetic field passing through each of the amorphous magnetic members 9 and 9*a* are provided in a region of a main body 11*a*, the region facing the print head 8 at a stop position.

Figure 3A:
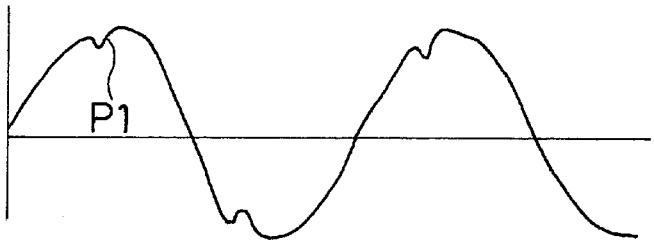
FIGS. 3A and 3B show a magnetic pulse generated in the device.
Figure 3B:
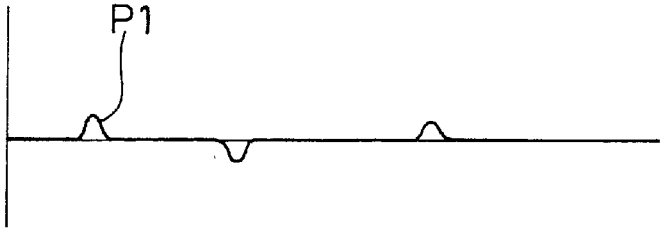

An exciting signal generating unit 11 supplies a sine-wave signal, having an amplitude for generating a magnetic pulse at a predetermined phase position with respect to the amorphous magnetic members 9 and 9*a*, to the exciting coil 10. A magnetic pulse extracting unit including preamplifiers 12 and 12*a* and differential amplifiers 13 and 13*a* is connected to the detecting coils 19 and 19*a*. That is, the sine-wave reference signal is supplied from the exciting signal generating unit 11 to the differential amplifiers 13 and 13*a* as one input signal and a detection signal (FIG. 3A) is also supplied as the other input signal. Further, a superimposed magnetic pulse P1 is extracted as a difference signal (FIG. 3B).

A verifying unit 15 verifies the cartridge based on whether or not a normal magnetic pulse P1 is extracted from the differential output signals from the detecting coils 19 and 19*a*, that is, whether or not the magnetic pulse P1 is generated at a predetermined phase position with respect to an AC period corresponding to the AC magnetic field, and on pattern recognition whether or not the pulse width and the amplitude correspond to a predetermined waveform A head-transport control unit 17, which controls the transport of the print head 8 in the line direction during printing, receives a lock signal which is generated when an attached sensor detects that the ink cartridges 2 and 3 are installed and the claws 4*b* and 5*b* are engaged with the hooks 4*a* and 5*a*, and generates a start signal when the print head 8 is at the stop position so as to operate the verifying unit 15.

When the magnetic pulse P1 is not extracted at the predetermined phase position of the detection signal of at least one of the detecting coils 19 and 19*a*, or when the magnetic pulse P1 is extracted and is determined not to be a normal pattern by the verifying unit 15, a print preventing unit 16 responds to the determination signal and controls the head-transport control unit 17 to stop the operation of the print head 8 in the line direction so that printing cannot be performed.

Now, the operation of the device for verifying an ink cartridge for a color printer will be described. When the black ink cartridge 2 or the color ink cartridge 3 or both cartridges 2 and 3 are replaced, and when it is detected that the lids 4 and 5 is locked, the exciting coil 10 excites the amorphous magnetic members 9 and 9*a* in the AC magnetic field for a predetermined time at the stop position of the print head 8. At that time, it is determined whether or not the normal magnetic pulse P1 is extracted from the detecting coils 19 and 19*a*.

When the magnetic pulse P1 extracted from both of the detecting coils 9 and 9*a* is determined to be normal, the color printer 1 operates normally. When one of the ink cartridges 2 and 3 or both of them are replaced by a non-genuine cartridge, the magnetic pulse is not extracted if the amorphous magnetic member is not provided on the cartridge. Also, when a non-genuine amorphous magnetic member is attached, the magnetic pulse is not generated at the predetermined phase position if the type of member is different. Even if a magnetic pulse is generated, the waveform or amplitude does not match. Accordingly, the verifying unit 15 controls the head-transport control unit 17 so as to operate the print preventing unit 16 so that printing cannot be performed.

In this embodiment, the detecting coil is attached to each of the black ink cartridge 2 and the color ink cartridge 3 and one common exciting coil is used for both cartridges 2 and 3. However, two exciting coils may be provided for the respective cartridges 2 and 3.

Figure 4:
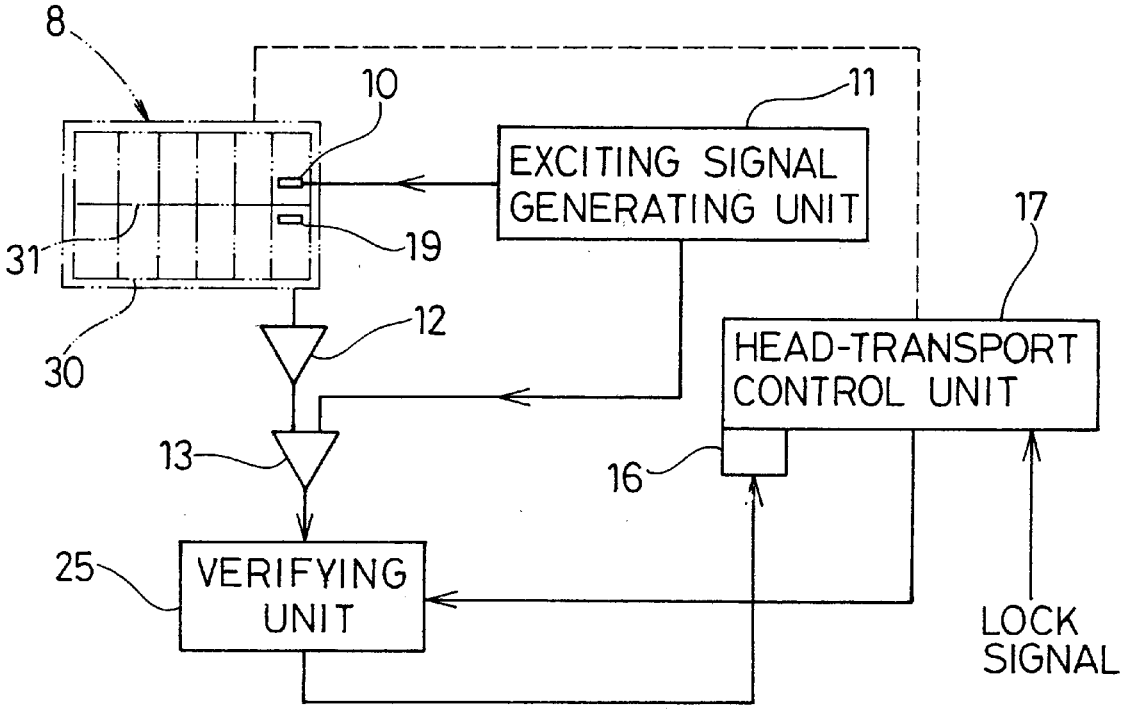
FIG. 4 shows the configuration of a device for verifying an ink cartridge according to another embodiment.
Figure 5:
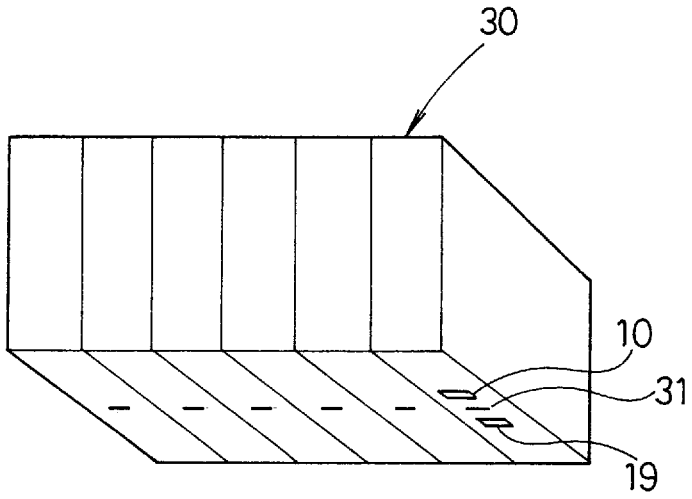
FIG. 5 is a perspective view showing ink cassettes to be verified by the device shown in FIG. 4.

FIGS. 4 and 5 show a device for verifying an ink cartridge according to another embodiment. In this embodiment, a linear thin-film amorphous magnetic member 31 is attached to the bottom surface of each of six ink cartridges 30 in which coloring agent can be separately replaced. An exciting coil 10 and a detecting coil 19 are provided in the region of the main body, facing the innermost ink cartridge 30 at the stop position of the print head 8. When any of the ink cartridges 30 is replaced, the head-transport control unit 17 reciprocates the print head 8 for a test in response to the lid lock signal and operates a verifying unit 25, which has the same function as in the foregoing embodiment, when each of the ink cartridges 30 moves to the position of the innermost ink cartridge 30, one after another. Accordingly, the amorphous magnetic members 31 of all the ink cartridges 30 are excited and scanned. When a normal magnetic pulse is not detected when facing any of the ink cartridges 30, the print preventing unit 16 is operated so that printing cannot be performed.

Figure 6:
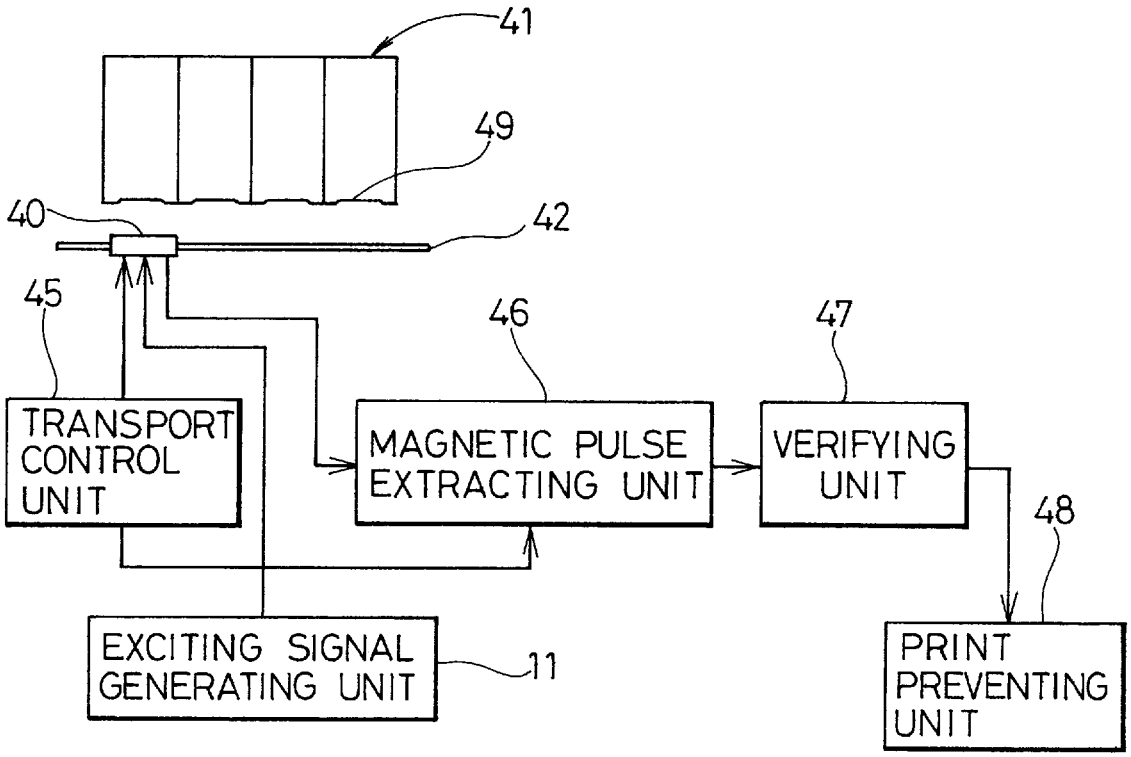
FIG. 6 shows the configuration of a device for verifying a toner cartridge according to still another embodiment.

In the above-described embodiments, the present invention is applied to a color inkjet printer. However, the present invention can be applied to a laser printer in which a replaceable toner cartridge is loaded. In this case, as shown in FIG. 6, a scanning head 40 including an exciting coil and a detecting coil is mounted on a rail 42 placed along the alignment direction of four fixed toner cartridges 41 including cyan, magenta, yellow, and black. The scanning head 40 can move on the rail 42. A linear thin-film amorphous magnetic member 49 is embedded in the bottom surface of each of the toner cartridges 41 so as to be parallel with the scanning head 40. Accordingly, when the replacement of any of the toner cartridges 41 is detected, a transport control unit 45 drives the scanning head 40 and the scanning head 40 scans the toner cartridges 41 in order from the end so that the determination is performed. A verifying unit 47 responds to the timing signal of the transport control unit 45 and verifies the amorphous magnetic member 49 of the toner cartridge 41 which has moved to the determination position based on the extraction signal of a magnetic pulse extracting unit 46, in the method as described above. When a normal magnetic pulse is not detected, a print preventing unit 48 operates so that printing cannot be performed.

What is claimed is:

1. A method for verifying a replaceable coloring agent cartridge loaded in a printer, comprising:

providing an amorphous magnetic member on a genuine coloring agent cartridge to be loaded in a main body;

providing, in the main body, an exciting coil for exciting the amorphous magnetic member in an AC magnetic field and a detecting coil for detecting the AC magnetic field passing through the amorphous magnetic member; and verifying the coloring agent cartridge based on whether or not a magnetic pulse which is generated at a predetermined level of the AC magnetic field and which is superimposed on a detection signal of the detecting coil is generated at a predetermined phase position in a period of the AC magnetic field.

2. The method according to claim 1, further comprising:

verifying the coloring agent cartridge based on pattern recognition such as the amplitude and pulse width of the magnetic pulse, in addition to whether or not the magnetic pulse is generated at the predetermined phase position in the period of the AC magnetic field.

3. A device for verifying a replaceable coloring agent cartridge loaded in a printer, comprising:

an amorphous magnetic member provided on the coloring agent cartridge to be loaded in a main body;

an exciting coil for exciting the amorphous magnetic member in an AC magnetic field and a detecting coil for detecting the AC magnetic field passing through the amorphous magnetic member, the coils being provided in the main body;

verifying means for verifying the coloring agent cartridge based on whether or not a magnetic pulse which is generated at a predetermined level of the AC magnetic field and which is superimposed on a detection signal of the detecting coil is generated at a predetermined phase position in a period of the AC magnetic field; and print preventing means for stopping the operation of the printer so that printing cannot be performed when the coloring agent cartridge is determined to be non-genuine.

4. The device according to claim 3, wherein the printer is a color printer in which a plurality of replaceable coloring agent cartridges can be loaded, and at least the detecting coil is provided for each of the coloring agent cartridges, the detecting coils being arranged in parallel.

5. The device according to claim 3, wherein the printer is a color printer in which a plurality of replaceable coloring agent cartridges can be loaded in a print head, which moves in the line direction, and one exciting coil and one detecting coil are provided along a transport path of the print head so as to scan and verify the plurality of coloring agent cartridges in order when the print head moves in the line direction.

6. The device according to claim 3, wherein the printer is a color printer in which a plurality of replaceable coloring agent cartridges can be loaded, and one exciting coil and one detecting coil are provided so as to move on a rail placed along the alignment direction of the plurality of coloring agent cartridges so as to scan and verify the plurality of coloring agent cartridges in order.

7. The device according to claim 3, further comprising:

magnetic pulse extracting means for extracting the magnetic pulse superimposed on the detection signal of the detecting coil, wherein the verifying means verifies the coloring agent cartridge based on pattern recognition such as the amplitude and pulse width of the magnetic pulse, in addition to whether or not the extracted magnetic pulse is generated at the predetermined phase position in the period of the AC magnetic field.

8. The device according to claim 3, wherein the verifying means verifies the coloring agent cartridge when it is detected that the coloring agent cartridge is loaded in the main body.

* * * * *

UNITED STATES PATENT AND TRADEMARK OFFICE

CERTIFICATE OF CORRECTION

PATENT NO. : 6,663,213 B2
DATED : December 16, 2003
INVENTOR(S) : Kosugi

It is certified that error appears in the above-identified patent and that said Letters Patent is hereby corrected as shown below:

Column 3,
Line 38, now reads “11a” should read -- 1a --

Signed and Sealed this

Twenty-second Day of June, 2004

JON W. DUDAS
*Acting Director of the United States Patent and Trademark Office*